US008054322B2

(12) United States Patent
Lee

(10) Patent No.: US 8,054,322 B2
(45) Date of Patent: Nov. 8, 2011

(54) COMPUTER SYSTEM AND CONTROL METHOD THEREOF

(75) Inventor: Moon-seok Lee, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1054 days.

(21) Appl. No.: 11/875,182

(22) Filed: Oct. 19, 2007

(65) Prior Publication Data

US 2008/0112638 A1 May 15, 2008

(30) Foreign Application Priority Data

Nov. 10, 2006 (KR) ..... 10-2006-0111016

(51) Int. Cl.
*G09G 5/02* (2006.01)

(52) U.S. Cl. ..... 345/698; 345/3.4; 345/699; 348/177

(58) Field of Classification Search ..... 345/3.4, 345/698, 699; 348/177
See application file for complete search history.

(56) References Cited

U.S. PATENT DOCUMENTS

| | | | | |
|---|---|---|---|---|
| 7,154,493 | B2 * | 12/2006 | Yee | 345/211 |
| 2005/0052473 | A1 * | 3/2005 | Nason et al. | 345/661 |
| 2006/0071949 | A1 * | 4/2006 | Sakuma et al. | 345/660 |

FOREIGN PATENT DOCUMENTS

| | | |
|---|---|---|
| JP | 8-65592 | 3/1996 |
| KR | 1999-86027 | 12/1999 |
| KR | 2005-79137 | 8/2005 |

* cited by examiner

*Primary Examiner* — Richard Hjerpe
*Assistant Examiner* — Sahlu Okebato
(74) *Attorney, Agent, or Firm* — Stanzione & Kim, LLP

(57) ABSTRACT

A method of controlling a computer system having a computer to generate and to transmit a video signal, a display to display the video signal transmitted from the computer, and an interface through which the computer communicates with the display, the method including transmitting a control command to check a blank edge line from the computer to the display; receiving the control command and determining whether an edge line of an image display area of the display is blank according to the control command; transmitting blank checking data from the display to the computer; and adjusting resolution of the image signal and transmitting the image signal from the computer to the display based on the transmitted blank checking data.

21 Claims, 6 Drawing Sheets

FIG. 2

| VCP Code | Standard VCP Proposal. |
|---|---|
| 0 | Degauss. |
| 1 | |
| 2 | |
| 3 | |
| 4 | Reset. |
| 5 | |
| 6 | |
| 7 | |
| 8 | |
| 9 | |
| A | |
| B | |
| C | |
| D | |
| E | CLOCK. |
| F | |
| 10 | Brightness. |
| 11 | |
| 12 | Contrast. |
| 13 | |
| 14 | Select Color Preset (80h=sRGB) |
| 15 | |
| 16 | Red Video Gain. |
| 17 | |
| 18 | Green Video Gain. |
| 19 | |
| 1A | Blue Video Gain. |
| 1B | |
| 1C | Focus. |
| 1D | |
| 1E | |
| 1F | |
| 20 | Horizontal Position. |
| 21 | |
| 22 | Horizontal Size. |
| 23 | |
| 24 | Horizontal Pincushion. |
| 25 | |
| 26 | Horizontal Pincushion Balance. |
| 27 | |
| 28 | Horizontal Misconvergence. |
| 29 | |
| 2A | Horizontal Linearity. |
| 2B | |
| 2C | Horizontal Linearity Balance. |
| 2D | |
| 2E | |

| VCP Code | Standard VCP Proposal. |
|---|---|
| 2F | |
| 30 | Input Level Select. |
| 31 | |
| 32 | Vertical Size. |
| 33 | |
| 34 | Vertical Pincushion. |
| 35 | |
| 36 | Vertical Pincushion Balance. |
| 37 | |
| 38 | Vertical Misconvergence. |
| 39 | |
| 3A | Vertical Linearity. |
| 3B | |
| 3C | Vertical Linearity Balance. |
| 3D | |
| 3E | CLOCK PHASE. |
| 3F | |
| 40 | Key Balance. |
| 41 | |
| 42 | Trapezoidal Distortion(Key). |
| 43 | |
| 44 | Tilt(Rotation). |
| 45 | |
| 46 | Top Corner Distortion. |
| 47 | |
| 48 | Top Corner Distortion Balance. |
| 49 | |
| 4A | |
| 4B | |
| 4C | Bottom Corner Distortion Balance. |
| 4D | |
| 4E | |
| 4F | |
| 50 | |
| 51 | |
| 52 | |
| 53 | |
| 54 | COLOR TEMPERATURE. |
| 55 | |
| 56 | Horizontal Moire. |
| 57 | |
| 58 | Vertical Moire. |
| 59 | |
| 5A | |
| 5B | |
| 5C | |
| 5D | |

| VCP Code | Standard VCP Proposal. |
|---|---|
| 5E | Input Level Select. |
| 5F | |
| 60 | Input Source Select. |
| 61 | |
| 62 | |
| 63 | |
| 64 | |
| 65 | |
| 66 | |
| 67 | |
| 68 | |
| 69 | |
| 6A | CLEAR TYPE. |
| 6B | |
| 6C | Red Video Black Level. |
| 6D | |
| 6E | Green Video Black Level. |
| 6F | |
| 70 | Blue Video Black Level. |
| 71 | |
| 72 | HorAdd. |
| 73 | |
| 74 | VerAdd. |
| 75 | |
| 76 | BufferAdd. |
| 77 | |
| 78 | Update. |
| 79 | |
| 7A | Adjust Focal Plane. |
| 7B | |
| 7C | Adjust Zoom. |
| 7D | |
| 7E | Trapezoid. |
| 7F | |
| 80 | Keystone. |
| 81 | |
| 82 | HorFlip. |
| 83 | |
| 84 | VertFlip. |
| 85 | |
| 86 | Display Scaling. |
| 87 | |
| 88 | Velocity Scan Modulation. |
| 89 | |
| 8A | TV Color Saturation. |
| 8B | |
| 8C | TV-Sharpness. |
| 8D | |
| 8E | TV-Contrast. |
| 8F | |

COMPUTER SYSTEM AND CONTROL METHOD THEREOF

CROSS-REFERENCE TO RELATED APPLICATIONS

This application claims priority under 35 U.S.C. §119(a) from Korean Patent Application No. 2006-0111016, filed on Nov. 10, 2006 in the Korean Intellectual Property Office, the disclosure of which is incorporated herein in its entirety by reference.

BACKGROUND OF THE INVENTION

1. Field of the Invention

The present general inventive concept relates to a computer system and a control method thereof, and more particularly, to a computer system to adjust over-scan, and a control method thereof.

2. Description of the Related Art

As display technology has improved with high speed, resolution of a television (TV) is improved to a standard definition (SD) level and a high definition (HD) level, and accordingly, the TV can be changed to a display providing multi-functions rather than providing a broadcast program to be viewed. That is, a currently released TV has multi-functions so that the TV is connected with various image sources and displays the corresponding image.

However, in order to remove noise components in an edge portion of a screen, a TV manufacturer increases an input screen frame to be larger than a substantial image during a television manufacturing process. That is, the TV manufacturer produces a television with an over-scanned input screen frame. Accordingly, an image displayed on a TV screen may be partially lost in an edge portion of the TV when the TV displays an image not from a broadcasting signal but in connection with an external image source (e.g., a personal computer (PC)).

In general, a screen of a PC displays various menus, including a start menu, and icons in edge portions, particularly in a bottom edge portion of the screen, and therefore a user may experience inconvenience when important information is displayed on the edge portion of the screen.

SUMMARY OF THE INVENTION

The present general inventive concept provides a computer system to compensate an over-scanned screen, and a control method thereof.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept can be achieved by providing a method of controlling a computer system having a computer to generate and transmit a video signal, a display to display the video signal transmitted from the computer, and an interface through which the computer communicates with the display, the method including transmitting a control command from the computer to check a blank edge line to the display, receiving the control command at the display and determining whether an edge line of an image display area of the display is blank according to the control command, transmitting blank checking data from the display to the computer, and adjusting resolution of the image signal and transmitting the image signal from the computer to the display based on the transmitted blank checking data.

The adjusting of the resolution of the image signal to be transmitted to the display may include reducing the resolution of the image signal by predetermined lines and retransmitting the control command to check the blank edge line to the display when the edge line is not blank.

The adjusting of the resolution of the image signal to be transmitted to the display may include maintaining resolution of the image signal when the edge line is blank.

The control command may include a check command to check at least one blank edge line among left, right, top, and bottom edge lines of the image display area.

The computer and the display may communicate the control command and the blank checking data with each other by using a display data channel commands interface (DDC/CI) communication protocol, and the control command may be transmitted as a virtual control panel (VCP) code according to a monitor control command set (MCCS) standard.

The foregoing and/or other aspects and utilities of the present general inventive concept can also be achieved by providing a computer system including a graphic controller to generate and to transmit an image signal, and to transmit a control command to detect a blank edge line of the display, a display unit to receive and to display the image signal, a display controller to determine whether an edge line of an image display area of the display unit is blank according to the control command transmitted from the graphic controller and to transmit blank checking data on the determination to the graphic controller, and an interface through which the graphic controller and the display controller communicate data with each other, wherein the graphic controller adjusts a resolution of the image signal based on the blank checking data transmitted from the display controller and transmits the image signal to the display.

The interface may include a display data channel commands interface (DDC/CI) communication line, and the display controller may correspond to a DDC/CI controller.

The control command may be a DDC/CI command, and may correspond to a virtual control panel (VCP) code according to a monitor control command set (MMSC) standard.

The graphic controller may reduce the resolution of the image signal when the edge line is not blank and may retransmit the control command to detect the blank edge line to the DDC/CI controller, based on the blank checking data.

The graphic controller may maintain the resolution of the image signal when the edge line is blank.

The control command may include a determination command for at least one blank edge line among up, down, left, and right edge lines of the image display area.

The foregoing and/or other aspects and utilities of the present general inventive concept can also be achieved by providing an image system, including an image source to generate and to transmit an image signal, a display to receive and display the image signal, and a display controller to determine whether an edge line of the displayed image signal is blank and to communicate the determination to the image source, wherein the image source adjusts a resolution of the image signal if the display controller determines that the edge line is not blank.

The image system may further include an interface to communicate data between the image source and the display.

The image source may sequentially adjust the resolution of the image signal corresponding to a determination that at least one of a left, right, top, and bottom edge lines of the image is not blank.

The image source may not adjust the resolution of the image signal when one of the left, right, top, and bottom edge lines of the image is blank.

The foregoing and/or other aspects and utilities of the present general inventive concept can also be achieved by providing a method of controlling an image displaying system, the method including transmitting an image signal to a display from an image source, displaying the image signal in the display, determining whether an edge line of the displayed image signal is blank and communicating a result of the determination to the image source, adjusting a resolution of the transmitted image according to the communicated determination.

The adjusting of the resolution may include sequentially determining whether left, right, top, and bottom edge lines of the displayed image signal are not blank, and the adjusting of the resolution may include adjusting the resolution of the transmitted image signal until left, right, top, and bottom edge lines are determined to be blank.

The adjusting of the resolution may further include adjusting a horizontal size of the displayed image signal once the left and right edge lines are determined to be blank, and adjusting a vertical size of the displayed image signal once the left and right edge lines are determined to be blank.

The foregoing and/or other aspects and utilities of the present general inventive concept can also be achieved by providing a computer readable recording medium comprising computer readable codes to control an image displaying system, including transmitting an image signal to a display from an image source, displaying the image signal in the display, determining whether an edge line of the displayed image signal is blank and communicating a result of the determination to the image source, and adjusting a resolution of the transmitted image according to the communicated determination.

The foregoing and/or other aspects and utilities of the present general inventive concept can also be achieved by providing a computer readable recording medium comprising computer readable codes to control a computer system having a computer to generate and transmit a video signal, a display to display the video signal transmitted from the computer, and an interface through which the computer communicates with the display, the method including transmitting a control command from the computer to check a blank edge line to the display, receiving the control command and determining whether an edge line of an image display area of the display is blank according to the control command, transmitting blank checking data from the display to the computer, and adjusting resolution of the image signal and transmitting the image signal from the computer to the display based on the transmitted blank checking data.

BRIEF DESCRIPTION OF THE DRAWINGS

These and/or other aspects and utilities of the present general inventive concept will become apparent and more readily appreciated from the following description of the exemplary embodiments, taken in conjunction with the accompany drawings of which:

FIG. 2 is a schematic diagram illustrating a virtual control panel (VCP) table;

DETAILED DESCRIPTION OF THE PREFERRED EMBODIMENTS

Figure 1:
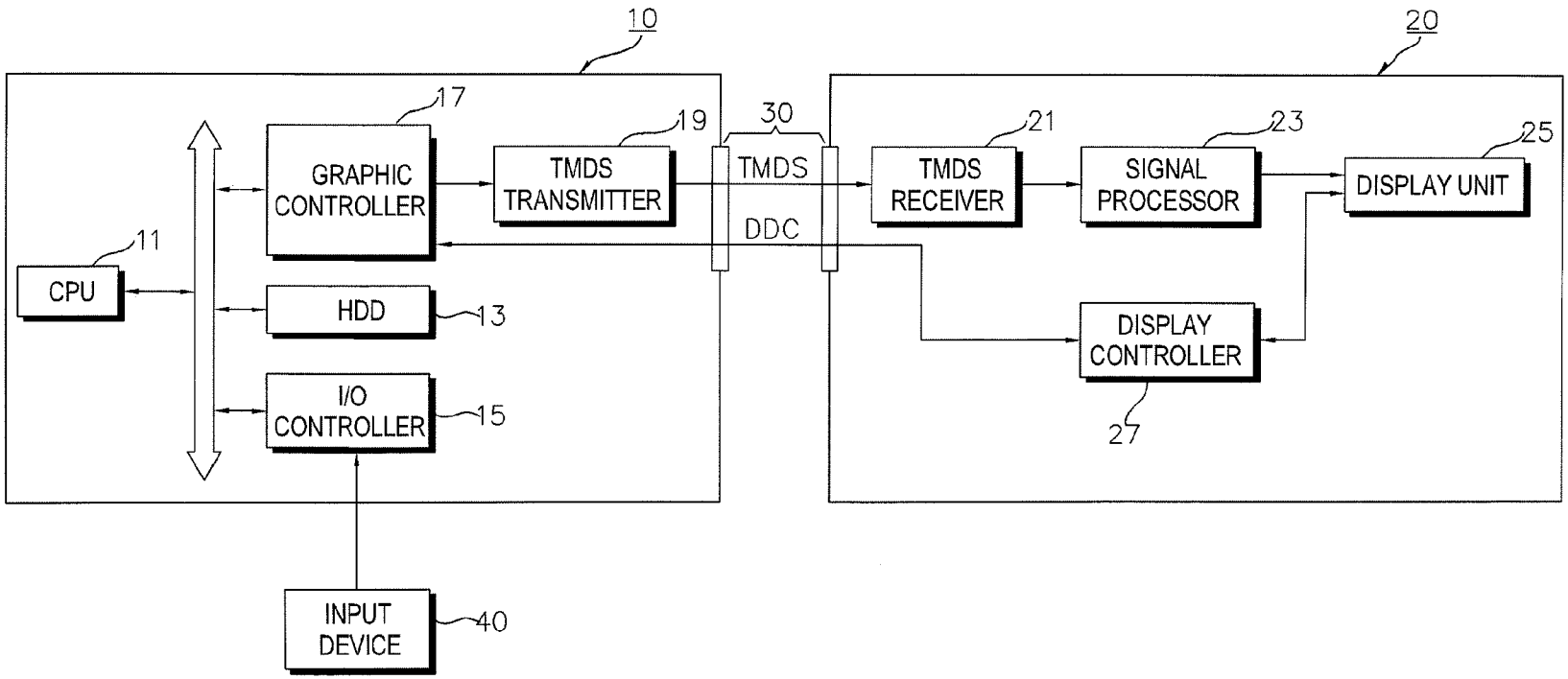
FIG. 1 is a control block diagram illustrating a computer system according to an exemplary embodiment of the present general inventive concept.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

FIG. 1 is a control block diagram illustrating a computer system according to an exemplary embodiment of the present general inventive concept.

As illustrated in FIG. 1, the computer system may include a computer 10 to generate and to transmit an image signal, a display 20 to display an image transmitted from the computer 10, and an interface unit 30 to communicate data between the computer 10 and the display 20.

The computer 10 may include a central processor unit (CPU) 11, a hard disk drive (HDD) 13, an input/output controller (I/O Controller) 15, a graphic controller 17, and a transition minimized differential signaling (TMDS) transmitter 19. Herein, the CPU 11, HDD 13, and I/O controller 15 are similar to a conventional CPU, HDD, and I/O controller, respectively, and therefore further descriptions thereof will be omitted.

The graphic controller 17 generates and outputs an image signal, and can be provided as a video graphics adapter (VGA) card or an integrated card.

In addition, the graphic controller 17 communicates data with the display 20. For example, the graphic controller 17 may perform inter-integrated circuit (I2C) data communication, which is a display data channel-command interface (DDC/CI) communication protocol between the VGA card and the display.

The DDC/CI communication protocol is a data communication protocol between a VGA card and the display 20, defined by the Video Electronics Standards Association (VESA), and it can be divided into DDC1 and DDC2 standards. The DDC1 standard receives information about the display 20 when the computer 10 is booted, and realizes a screen appropriate for an output format of the display 20, and the DDC2 standard supports bi-directional communication. The DDC2 standard includes a DDC2AB standard that enables the display 20 to be operated both in a master mode and a slave mode to the computer 10, and a DDC2B1 standard that enables the display 20 to be operated in the slave mode to the computer 10.

The above embodiment of the present general inventive concept uses the DDC1 standard and the DDC2BI standard as the DCC.

In a case of the DDC1 standard, when the computer 10 is booted, and thus a vertical synchronization signal is input to the display 20, the display 20 transmits internally stored extended display identification data (EDID) to the computer 10. The EDID is display information including a manufacturer, a manufacturing date, a serial number, and resolution. The graphic controller 17 perceives display information through the EDID data, and outputs an image signal according to the corresponding format. In this case, since a display unit 25 of a personal computer and a display unit of a television have different EDID values from each other, the graphic controller 17 can figure out whether the corresponding display is used for a television (TV) based on EDID transmitted when the computer 10 is booted. That is, an over-scan problem occurs only in the display 20 used for a TV, and therefore the graphic controller 17 may control the following operation to be performed only when the display 20 is used for a TV based on the EDID.

Based on the DDC2BI communication protocol, the graphic controller 17 transmits a control command to the display 20 in order to request the display 20 to determine whether an edge line of an image currently displayed on the display 20 is blank. When a response signal of the display 20 shows that the edge line is not blank, the graphic controller 17 reduces the image screen frame and outputs an image. Therefore, the over-scan problem of the display 20 can be solved.

In this case, the control command includes a command to determine whether at least one edge line among top, bottom, left, and/or right edge lines is blank.

In addition, the graphic controller 17 and the display 20 use a virtual control panel (VCP) code as the control command and the response signal, respectively. The VCP is specified in the monitor control command set (MCCS) standard referenced by the DDC2BI communication protocol.

FIG. 2 partially illustrates a currently-available VCP code table. According to the MCCS standard, there exists an area where a manufacturer can freely define and use the VCB code, and according to an exemplary embodiment of the present general inventive concept, a new command is added to the area and used. For example, undefined codes (e.g., 64, 65, 66, and 67 of FIG. 2) can be respectively defined as "Check Left Blank Line," "Check Right Blank Line," "Check Top Blank Line," and "Check Bottom Blank Line" to check left/right/top/bottom edge lines.

The graphic controller 17 will be described in further detail later.

The TMDS transmitter 19 converts an image signal and control data output from the graphic controller 17 into a TMDS transmission protocol and outputs the TDMS transmission protocol to the display 20.

In this case, a digital visual/Video interface (DVI) connector or a high-definition multimedia interface (HDMI) connector can be used as an interface 30 to communicate data between the computer 10 and the display 20.

The display 20 according to the exemplary embodiment illustrated in FIG. 1 may include a TMDS receiver 21, a signal processor 23, a display unit 25, and a display controller 27.

The TMDS receiver 21 converts an image signal transmitted from the computer 10 according to a processing format of the signal processor 23 and outputs the conversion result. The signal processor 23 scales the image signal transmitted from the TMDS receiver 21 according to an output format of the display unit 25 and provides the scaled image signal to the display 25, and may include an image processing module (e.g., a scalar).

The display unit 25 displays the signal-processed image signal thereon, and includes a display panel (not illustrated) on which an image is displayed, and a panel driver (not illustrated) to control driving of the display panel. The display unit 25 can be provided as various types of display modules, such as digital light processing (DLP) device, a liquid crystal display (LCD), and a plasma display panel (PDP) according to the exemplary embodiment illustrated in FIG. 1.

The display controller 27 communicates data with the graphic controller 17 of the computer 10 based on the DDC/CI protocol, and a DDC/CI-dedicated IC, a micro controller (MICOM), or a micro controller unit (MCU) may also be equipped with a corresponding module.

When receiving a VCP code which is a control command to check an existence of a blank edge line from the graphic controller 17 through a DDC/CI communication line, the display controller 27 checks whether an edge line of the image displayed on the display unit 25 is blank, and transmits confirmation data on the checking result to the graphic controller 17 through the DDC/IC communication line. In addition, the display controller 27 transmits EDID information to the graphic controller 17 so as to control the computer 10 to perceive status information of the display 20. The EDID information is stored in the display controller 27 when the computer 10 is booted, and thus the vertical synchronization signal is input.

A control method of the computer system of FIG. 1 will be described with reference to FIG. 3A and FIG. 3B.

Figure 3A:
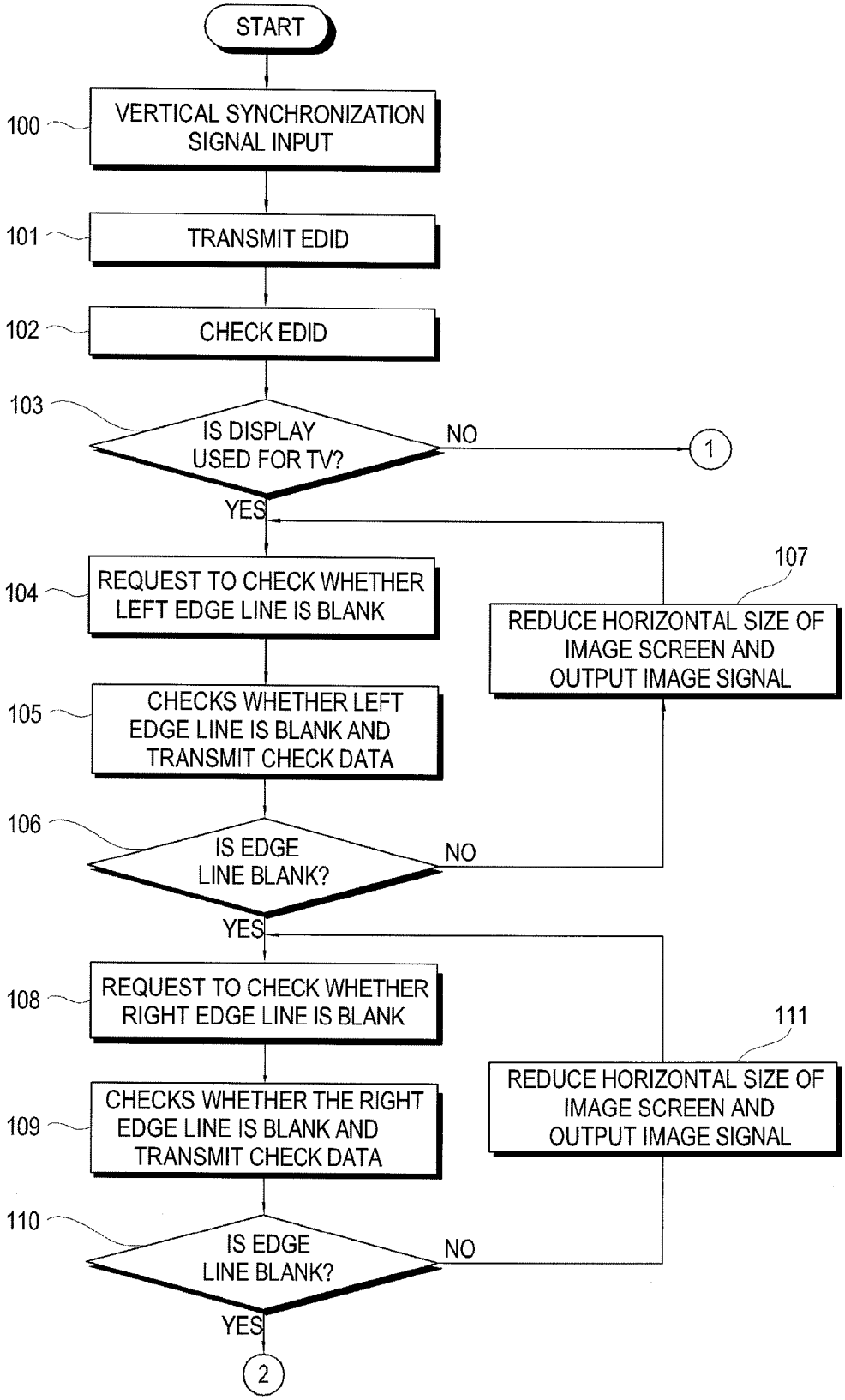
FIG. 3A and FIG. 3B are a control flowchart of the computer system illustrated in FIG. 1.

As illustrated in FIG. 3A, when a vertical synchronization signal is input at operation 100, the display controller 27 transmits stored EDID information to the computer 10, at operation 101.

The graphic controller 17 receives the EDID information and checks information of the display 20, at operation 102. In addition, the graphic controller 17 checks whether the display 20 is used for a TV through the EDID information at operation 103, and performs a series of processes to request checking of a blank edge line in an image screen displayed on the display 20 when the display 20 is used for a TV. As described above, an image is over-scanned so as to reduce noise in an edge portion when the display is used for a TV, and therefore the series of the above-stated processes is performed only when a display connected with the computer 10 is used for a television.

A request process to check edge lines from right, left, top, and bottom according to the exemplary embodiment of the present general inventive concept will be described. Reference numerals 104 to 112 of FIG. 3A illustrate a process to check left/right edge lines, and reference numerals 120 to 128 of FIG. 3B illustrate a process to check top/bottom edge lines.

The graphic controller 17 transmits a control command code to check whether a left edge line is blank, at operation 104. When receiving the control command code, the display controller 27 checks whether the left edge line is blank by detecting a pixel value of a left edge line of an image currently displayed on the display area of the display unit 25 and transmits blank checking data to the graphic controller 17, at operation 105. The graphic controller 17 determines whether the left edge line is blank based on the blank checking data transmitted from the display 20 at operation 106, and reduces a horizontal size of the image by a predetermined amount when the left edge line is not blank and outputs an image signal to the display 20, at operation 107. The number of reduced lines may properly vary depending on a product.

Then, operations 104 to 106 are repeated so as to check whether the size-reduced image is over-scanned. In this case, when the checking result shows that the left edge line is not blank, a horizontal size of the image is reduced by predetermined lines, and this process is repeated until the left edge line becomes blank. Accordingly, a horizontal size of an over-scanned image can be gradually adjusted.

However, when it is determined that the left edge line is blank, the graphic controller 17 performs a process to check whether a right edge line is blank, through operations 108 to 111. The process to determine whether the right edge line is blank is performed similar to the above-stated process for the left edge line. That is, whether the right edge line of the display area of the display unit 25 is blank is determined at operation 108, blank checking data for the determination result is transmitted at operation 109, a blank edge line is determined based on the blank checking data by the graphic controller 17 at operation 110, and a horizontal size of an image is adjusted and the image signal is output when the edge line is not blank, at operation 111.

Operations 108 to 110 are repeated to check whether the size-adjusted image is over-scanned. When an edge line of the display area is not blank, a horizontal size of the image screen is reduced by predetermined lines at operation 111, and this process is repeated until the edge line of the display area of the display unit 25 becomes blank. Accordingly, a horizontal size of an over-scanned image is gradually adjusted.

When the left and right edge lines of the display unit 25 are determined to be blank through the above-stated processes, the horizontal size of the image can be determined at operation 112 so that a horizontal over-scan problem of the image can be solved. That is, when the horizontal size of the image is reduced until the left and right edge lines of the display area of the display 25 are determined to be blank, a lost portion of the over-scanned image can be displayed on the display area so that the whole image can be displayed on the display area. In other words, a whole image can be displayed on the display area of the display unit 25 when edge lines of the display area become blank such that the over-scan problem can be solved.

Subsequently, processes to determine whether top/bottom edge lines are blank are performed through operations 120 to 128. When both the top edge line and the bottom edge lines are determined to be blank, a vertical size of the image is determined at operation 128 so that a vertical over-scan problem can be solved. The processes to determine whether the upper/lower edge lines are blank are similar to the above-stated operations 104 to 112 of FIG. 3A, and therefore further description on FIG. 3B will be omitted.

Figure 3B:
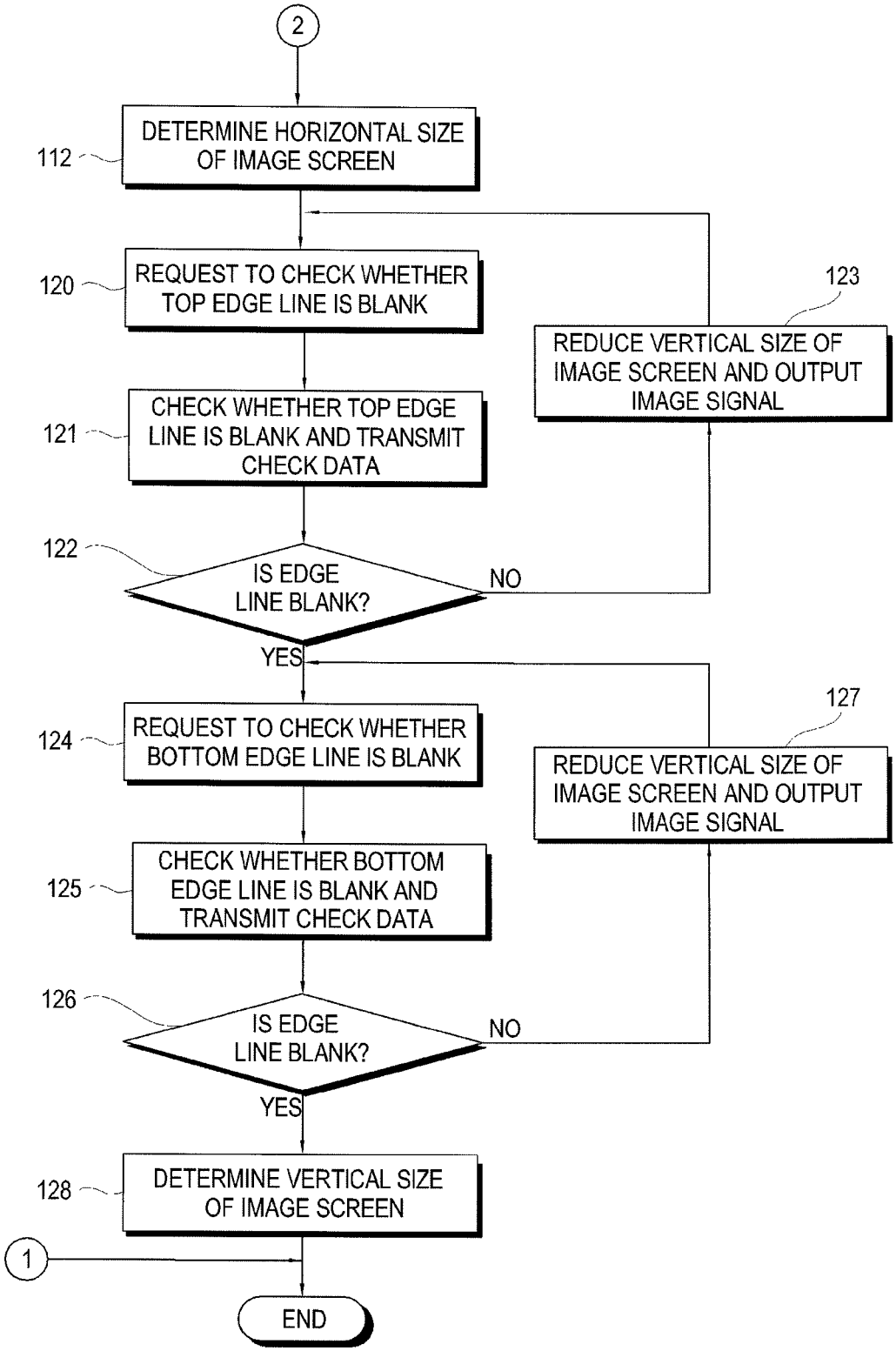

As described, the horizontal and vertical over-scan problems can be solved by performs the processes of FIG. 3A and FIG. 3B so that user can view a full screen image from an image source. That is, when the horizontal and vertical sizes of the image are reduced until the left/right/top/bottom edge lines of the display area of the display unit become blank, an effective image screen with color values can be fully displayed on the display area of the display unit 25, thereby solving the over-scan problem.

Figure 4A:
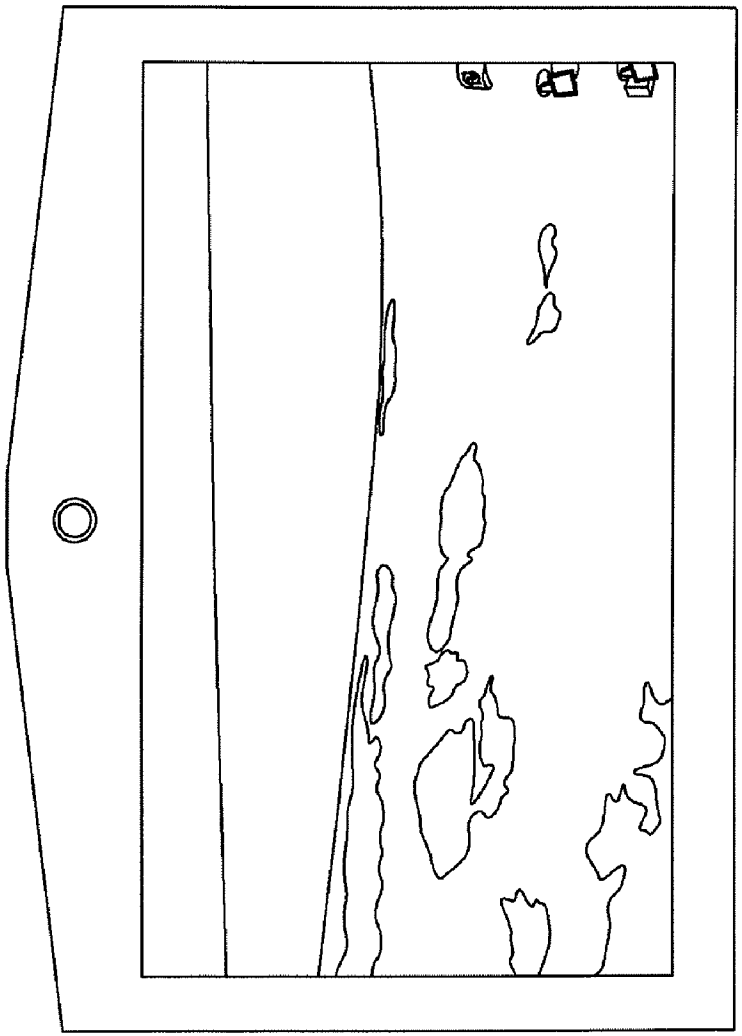
FIG. 4A and FIG. 4B respectively illustrate an overscanned screen and a corrected screen according to the exemplary embodiment of the present general inventive concept.
Figure 4B:
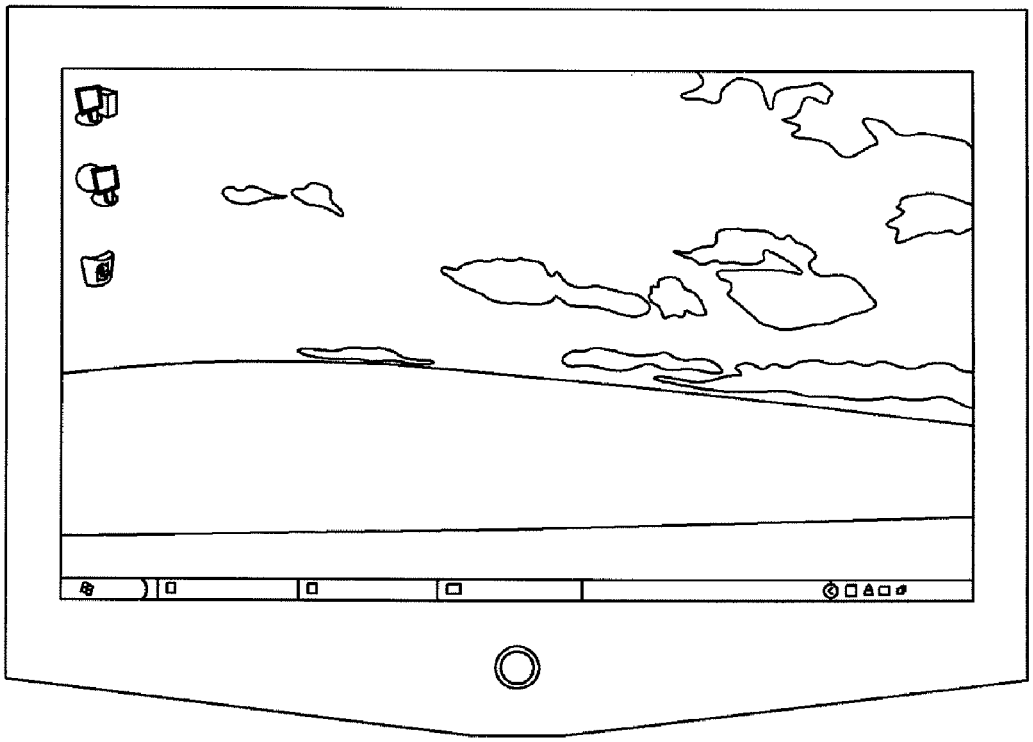

A result of re-sizing an image screen according to the exemplary embodiment of the present general inventive concept can be illustrated through comparison of FIG. 4A and FIG. 4B.

FIG. 4A illustrates an over-scanned screen when the display 20, having a TV function, is connected with a personal computer (PC). As illustrated in FIG. 4A, an icon on a left portion is partially lost due to over-scan of the display 20 and a menu bar at a bottom portion is lost.

In contrast, a full screen image of the PC can be displayed on the display 20 after performing the processes of FIG. 3A and FIG. 3B, as illustrated in FIG. 4B. Accordingly, the over-scan problem can be easily solved.

Another exemplary embodiment of the present general inventive concept will be described with reference to FIG. 1, FIG. 3A, and FIG. 3B. Constituent elements that are similar to those in the previously-described exemplary embodiment will not be further described.

In the previously-described exemplary embodiment, the computer 10 receives EDID information of the display 20 when the computer 10 is booted and determines whether the display 20 has a TV function, and this embodiment is implemented only when the display 20 has the TV function.

However, another exemplary embodiment of the present general inventive concept may be implemented by a user's request. Therefore, a computer system according to this exemplary embodiment of the present general inventive concept may further include an input device 40, as illustrated in FIG. 1. The input device 40 receives a user's input, and can be provided as a keyboard, a mouse, or a remote controller.

The input device 40 can be provided as a hot key on the keyboard or the remote controller, and can be realized by a click operation on a program execution icon of a graphic user interface (GUI).

When a user needs to adjust the size of an over-scanned image screen and thus press a hot key or click a menu of the start menu or an icon by using the input device, the I/O controller 115 transmits a corresponding interrupt signal through an interface, and the graphic controller 17 transmits a left edge line checking request signal to the display 20 responding to the interrupt signal as illustrated in the operation 104 of FIG. 3A. After that, operations 105 to 112 and operations 120 to 128 of FIG. 3B are sequentially performed. Accordingly, an over-scanned screen size is adjusted and displayed.

According to the above-stated exemplary embodiments of the present general inventive concept, the left/right/top/bottom edge lines are sequentially checked, but the present general inventive concept is not limited thereto, and the left, right, top, and/or bottom edges can be checked and/or corrected in other orders.

In addition, although the computer 10 and the display 20 communicate data with each other based on the DDC 2BI standard according to the exemplary embodiments of the present general inventive concept, another standard may be used when a bi-direction communication is available.

Various embodiments of the present general inventive concept can be embodied as computer readable codes on a computer readable recording medium. The computer readable recording medium may include any data storage device suitable to store data that can be thereafter read by a computer system. Examples of the computer readable recording medium include, but are not limited to, a read-only memory (ROM), a random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Various embodiments of the present general inventive concept may also be embodied in hardware or in a combination of hardware and software.

As described above, a computer system to compensate an over-scanned screen and a control method thereof can be provided.

Although a few exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of controlling a computer system having a computer to generate and transmit a video signal, a display to display the video signal transmitted from the computer, and an interface through which the computer communicates with the display, the method comprising:

transmitting a control command from the computer to check a blank edge line to the display;

receiving the control command at the display and determining whether an edge line of an image display area of the display is blank according to the control command;

transmitting blank checking data from the display to the computer; and adjusting resolution of the image signal and transmitting the image signal from the computer to the display based on the transmitted blank checking data.

2. The method of claim 1, wherein the adjusting of the resolution of the image signal to be transmitted to the display comprises reducing the resolution of the image signal by predetermined lines and retransmitting the control command to check the blank edge line to the display when the edge line is not blank.

3. The method of claim 2, wherein the adjusting of the resolution of the image signal to be transmitted to the display comprises maintaining resolution of the image signal when the edge line is blank.

4. The method of claim 1, wherein the adjusting of the resolution of the image signal to be transmitted to the display comprises maintaining resolution of the image signal when the edge line is blank.

5. The method of claim 2, wherein the control command includes a check command to check at least one blank edge line among left, right, top, and bottom edge lines of the image display area.

6. The method of claim 1, wherein the control command includes a check command to check at least one blank edge line among left, right, top, and bottom edge lines of the image display area.

7. The method of claim 2, wherein the computer and the display communicate the control command and the blank checking data with each other by using a display data channel commands interface (DDC/CI) communication protocol, and the control command is transmitted as a virtual control panel (VCP) code according to a monitor control command set (MCCS) standard.

8. The method of claim 1, wherein the computer and the display communicate the control command and the blank checking data with each other by using a display data channel commands interface (DDC/CI) communication protocol, and the control command is transmitted as a virtual control panel (VCP) code according to a monitor control command set (MCCS) standard.

9. A computer system comprising:

a graphic controller to generate and transmit an image signal, and to transmit a control command to detect a blank edge line of the display;

a display unit to receive and to display the image signal;

a display controller to determine whether an edge line of an image display area of the display unit is blank according to the control command transmitted from the graphic controller and to transmit blank checking data on the determination to the graphic controller; and an interface through which the graphic controller and the display controller communicate data with each other, wherein the graphic controller adjusts a resolution of the image signal based on the blank checking data transmitted from the display controller and transmits the image signal to the display.

10. The computer system of claim 9, wherein the interface comprises a display data channel commands interface (DDC/CI) communication line, and the display controller corresponds to a DDC/CI controller.

11. The computer system of claim 10, wherein the control command is a DDC/CI command, and corresponds to a virtual control panel (VCP) code according to a monitor control command set (MMSC) standard.

12. The computer system of claim 11, wherein the graphic controller reduces the resolution of the image signal when the edge line is not blank and retransmits the control command to detect the blank edge line to the DDC/CI controller, based on the blank checking data.

13. The computer system of claim 9, wherein the graphic controller reduces the resolution of the image signal when the edge line is not blank and retransmits the control command to detect the blank edge line to the DDC/CI controller, based on the blank checking data.

14. The computer system of claim 13, wherein the graphic controller maintains the resolution of the image signal when the edge line is blank.

15. The computer system of claim 12, wherein the graphic controller maintains the resolution of the image signal when the edge line is blank.

16. The computer system of claim 15, wherein the control command includes a determination command for at least one blank edge line among left, right, top, and bottom edge lines of the image display area.

17. The computer system of claim 14, wherein the control command includes a determination command for at least one blank edge line among left, right, top, and bottom edge lines of the image display area.

18. An image system, comprising:

an image source to generate and to transmit an image signal;

a display to receive and display the image signal; and a display controller to determine whether an edge line of the displayed image signal is blank and to communicate the determination to the image source, wherein the image source adjusts a resolution of the image signal if the display controller determines that the edge line is not blank.

19. The image system of claim 18, wherein the image source sequentially adjusts the resolution of the image signal corresponding to a determination that at least one of a left, right, top, and bottom edge lines of the image is not blank.

20. A method of controlling an image displaying system, the method comprising:

transmitting an image signal to a display from an image source;

displaying the image signal in the display;

determining whether an edge line of the displayed image signal is blank and communicating a result of the determination to the image source; and adjusting a resolution of the transmitted image according to the communicated determination.

21. The method of claim 20, wherein:

the adjusting of the resolution comprises sequentially determining whether left, right, top, and bottom edge lines of the displayed image signal are not blank, and the adjusting of the resolution comprises adjusting the resolution of the transmitted image signal until left, right, top, and bottom edge lines are determined to be blank.

* * * * *